United States Patent [19]

Corna et al.

[11] 4,316,571

[45] Feb. 23, 1982

[54] WALL CONSTRUCTION METHOD FOR SWIMMING POOLS

[76] Inventors: John F. Corna, 1542 N. Crest Ave., Columbus, Ohio 43220; Marcel H. Blais, 8085 Manitou Dr., Westerville, Ohio 43081

[21] Appl. No.: 57,647

[22] Filed: Jul. 16, 1979

Related U.S. Application Data

[62] Division of Ser. No. 918,793, Jun. 26, 1978, Pat. No. 4,179,761.

[51] Int. Cl.[3] ..... E04H 3/20

[52] U.S. Cl. ..... 228/173 C; 228/182; 228/184

[58] Field of Search ..... 4/172.15, 172.17, 172.19, 4/510; 228/182, 184, 173 C

[56] References Cited

U.S. PATENT DOCUMENTS

| | | | |
|---|---|---|---|
| 3,890,230 | 6/1975 | Patterson | 228/173 C X |
| 3,923,230 | 12/1975 | Patterson et al. | 228/141 |
| 4,112,526 | 9/1978 | Patterson | 4/172.17 |
| 4,121,307 | 10/1978 | Patterson | 4/172.17 |

*Primary Examiner*—Gil Weidenfeld
*Assistant Examiner*—Kenneth J. Ramsey

[57] ABSTRACT

A wall construction for swimming pools, and method of making same, wherein the pool wall, the recirculating system, gutter and conduit, the bottom wall seal, and the deck coping are all formed from four standardized sheet metal members. The capacity of the gutter and recirculating system can be selectively established, when the components are welded together without varying the dimensions of two main components. Also, the water line to pool deck distance can be selectively established during fabrication without dimensional variation of the two main components.

1 Claim, 3 Drawing Figures

WALL CONSTRUCTION METHOD FOR SWIMMING POOLS

REFERENCE TO CO-PENDING APPLICATION

This application is a division of our co-pending application Ser. No. 918,793 filed June 26, 1978, now U.S. Pat. No. 4,179,761.

BACKGROUND OF THE INVENTION

This invention relates to wall constructions for swimming pools, and the method of making same, and more particularly to a pool wall wherein the recirculating system and other components are fabricated from standardized sheet metal components, and wherein the capacity of the recirculating system as well as the water level to deck distance can be selectively established during fabrication without dimensional variation of two main components.

PROBLEMS IN THE ART

It is the present practice in the art to fabricate swimming pools, and particularly the larger commercial types, with the wall sections, recirculating system, gutters and conduits, and the deck copings from stainless steel sheet metal components. Examples of such constructions are shown in U.S. Pat. Nos. 3,890,230 and 3,923,230 to Patterson.

A problem has been present in such prior pool construction, in that the sheet metal components must be custom shaped and dimensional for each particular job requirement, thus precluding the fabrication of such metal pools from standardized components.

SUMMARY OF THE INVENTION

In general, the present invention comprises a novel pool wall construction, and method of fabricating same, wherein standardized sheet metal components are uniquely shaped, such that the components can be selectively assembled to obtain various capacities for the recirculating system without dimensional variation in the two main components of the assembly.

As another aspect of the invention, the standardized sheet metal components are of a unique configuration, whereby the components can be selectively assembled to obtain various height differentials between the water level and the pool deck elevation.

As another aspect of the present invention, the novel pool construction of the present invention comprises a standardized main sheet metal component that serves the multiple functions of a gutter top edge and inner wall, conduit inner wall, wall face, and bottom seal.

As another aspect of the present invention, the novel pool wall construction comprises a second standard main sheet metal component that serves the multiple functions of outer side and bottom walls of the gutter and recirculating conduit.

As still another aspect of the present invention, the novel pool wall construction comprises another standard sheet metal component of simple construction that serves the multiple functions of deck coping, as well as means for establishing the height differential between the water line and the deck elevation, without any dimensional changes in the two standard main components mentioned above.

As still another aspect of the present invention, the novel pool wall construction comprises another standard sheet metal component of simple construction that can easily be varied in dimension to establish the rate flow of filtered water to the pool. This accomplished without any dimensional changes in any of the above mentioned standard components.

It is another aspect of the present invention, to provide a novel pool wall construction wherein all components are welded together to form a monolithic unit with none of the welds exposed to view on the finished pool wall side. As a result the need for grinding and polishing of welds is eliminated, and simple and inexpensive welding can be used.

Further objects and advantages of the present invention will be apparent from the following description, reference being had to the accompanying drawings wherein a preferred form of embodiment of the invention is clearly shown.

DESCRIPTION OF THE PREFERRED EMBODIMENT

Figure 1:
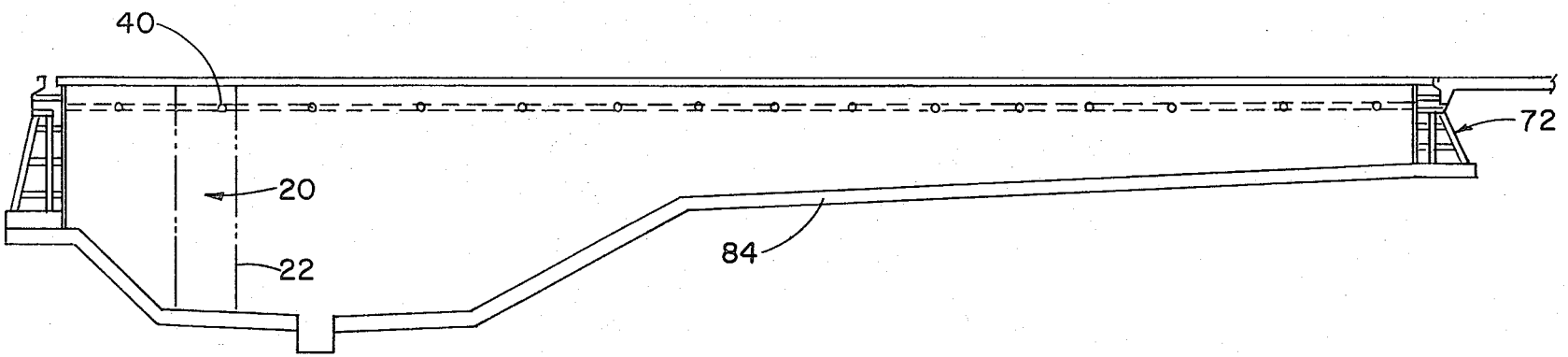
FIG. 1 is a side sectional view, a swimming pool constructed in accordance with the present invention, the section being taken along a vertical plane through the longitudinal center line of the pool.

Referring in detail to the drawing, FIG. 1 illustrates a typical swimming pool constructed in accordance with the present invention, with the walls of the pool being constructed of a plurality of wall forming sections 20 welded together in edge to edge relationship at vertical welded junctions 22.

Figure 2:
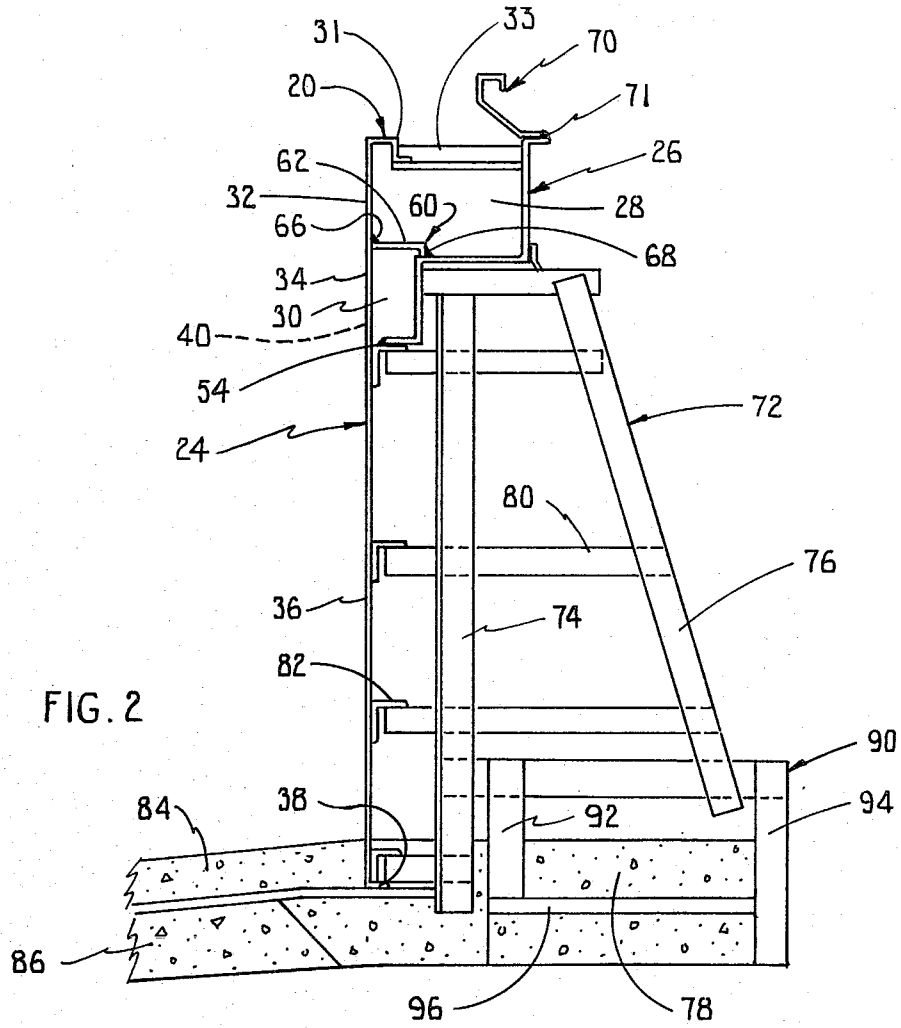
FIG. 2 is a side sectional view of a pool wall section constructed in accordance with the present invention.
Figure 3:
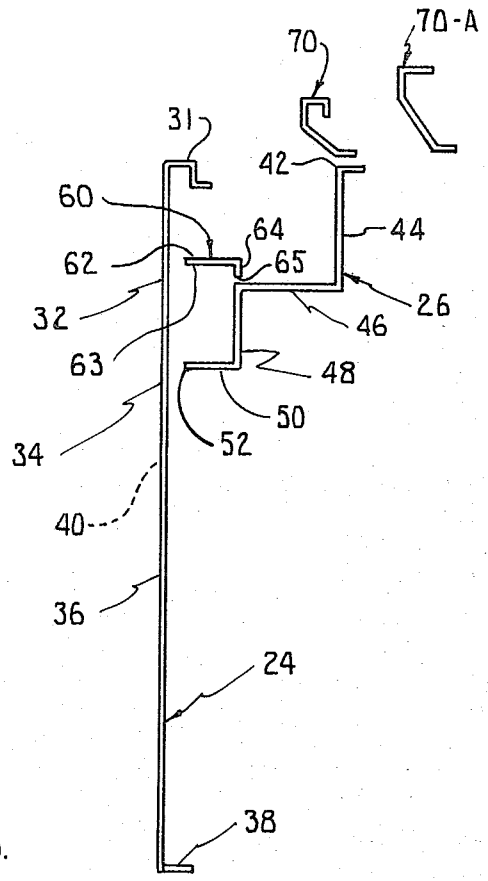
FIG. 3 is an exploded view of the pool wall section of FIG. 3.

Each of the sections comprises an assembly of stainless steel sheet metal components which components are welded together to form a standard monolithic pool wall section 20, as shown in detail in FIGS. 2 and 3.

The assembled section 20 consists of two main standard components which need never be dimensionally varied, and two secondary standard components that require minor variations in their height dimension only, and can be made up in several standard sizes and stocked in inventory if desired, so as to be in a position to handle all job requirements from a standardized inventory of prefabricated parts.

Referring to FIGS. 2 and 3, one of the standard main components comprises a first sheet metal member indicated generally at 24 which member provides the entire pool wall face and is fabricated from a single continuous sheet of stainless steel stock 48 inches high and 120 inches wide.

The other standard main component, which is never dimensionally varied, comprises a second sheet metal member indicated generally at 26 which member forms the outer side walls and bottom walls of both a water return gutter 28 and a filtered water supply conduit 30. Such gutter and conduit comprise portions of the recirculating system the other components of which are conventional and hence not illustrated herein.

As seen in FIGS. 2 and 3, the first main component 24 includes a horizontally inturned upper edge that forms a gutter inlet 31; an upper first sheet portion 32 forming a gutter inner wall, an intermediate first sheet portion 34, forming a conduit inner wall, a lower first sheet portion 36 forming the majority of the pool face, and a horizontal inturned flange 38 that is adapted to form a bottom seal.

The first main component 24 is also provided with one or more outlet orifices 40 which communicate with the interior of filtered water conduit 30 and thereby provide means for returning the filtered water to the pool.

Reference is next made to the second main component 26 which consists of a second sheet to edge 42, a gutter outer wall 44, a gutter bottom wall 46, a conduit outer wall 48, a conduit bottom wall 50 and an inner edge 52 that is joined to the first main sheet metal member 24 at a lower inner welded junction 54 as shown in FIG. 2.

Reference is next made to a secondary component indicated generally at 60 which includes a horizontal flange 62 that forms the conduit top wall and a portion of the gutter bottom wall. A downturned flange 64 may be varied in height in order to establish the flow capacity of conduit 30, and an inner edge 63 is joined to first component 24 at an upper inner welded junction 66. The outer edge 65 is joined to the second main component 26 at an upper outer welded junction 68 as shown in FIG. 3.

Another secondary component of the assembly is indicated generally at 70 and serves as the deck coping for a poured deck of concrete or other selected deck material. In addition, fourth sheet metal member 70 also provides means for establishing the deck to water level distance, by merely selecting another member of different height, such as 70-A shown in FIG. 3. This feature eliminates the need to vary the dimensions of any of the other sheet metal members. A lower edge 71 of secondary component 70 is joined to the top edge 42 of the second main component 26 at a horizontal coping weld 71.

With reference to FIG. 3, the assembled wall sections are mounted on a welded steel frame indicated generally at 72 which frame comprises upright frame members 74 and 76 the lower ends of which are supported by a poured footer 78. Frame 72 further includes horizontal frame members 80 the inner ends of which are cantilevered to receive the stringers 82.

Referring again to FIG. 3, a concrete pool bottom 84 is poured over a gravel bed 86 with the previously mentioned flange on the bottom of the main component 24 being imbedded in the concrete around the periphery of the pool, when the bottom is poured.

It should be mentioned that gutter 28 may be provided with a removeable perforated cover 33 which rests on small cover supports extended across the top of the gutter. In operation, the capacity of gutter 28 can be established during assembly by selecting the vertical location of the two inner weld junctions 54 and 66 with respect to inner gutter edge 30. This is accomplished without dimensional variation in main components 24 and 26.

The capacity of filtered water conduit 30 can also be established without dimensional variations in any of the other components, merely by selecting a secondary member 60 having the correct height for the desired cross-sectional area for the conduit.

The deck to water level height is also established during fabrication of the wall sections by selecting a secondary member 70 of required height and this is done without any dimensional variations in the other standard components.

It will be noted that all of the horizontal welded junctions are confined to the outer side of the first main component 24 and hence are hidden from the pool face side. Hence, the welding can be done by simple welding techniques without the requirements of grinding and polishing. This contributes greatly to the appearance and economy of fabrication of the pool structure.

While the form of embodiment shown and described constitutes preferred forms, it is to be understood that other forms might be adopted falling within the scope of the claims that follow.

What is claimed is:

1. The steps in the method of making swimming pool wall sections that include a gutter and recirculating conduit, which method comprises forming a first main sheet metal member from a single sheet of stock that is continuous from a top gutter-forming upper edge to bottom seal forming lower edge; forming a second main sheet metal member from a sheet of stock to include a gutter outer portion and a conduit outer portion; positioning said second member at a vertical position relative to said first member to establish a preselected cross-sectional area for the gutter; welding said second member to said first member whereby said first member forms inner walls for said gutter and conduit; forming a third sheet metal member with a vertical dimension selected to provide a preselected cross-sectional area for the conduit; welding said third sheet metal member between said two main members to form a top closure for the conduit; forming a deck coping member with a vertical dimension selected to position the top of the coping member at a preselected height above said gutter forming upper edge of the first main member; and welding said coping member to said gutter outer portion of the second main member.

* * * * *